US008685187B2

(12) United States Patent
Han et al.

(10) Patent No.: US 8,685,187 B2
(45) Date of Patent: Apr. 1, 2014

(54) PERFORATING DEVICES UTILIZING THERMITE CHARGES IN WELL PERFORATION AND DOWNHOLE FRACING

(75) Inventors: Chenghua Han, Sugar Land, TX (US); Hongfa Huang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/711,419

(22) Filed: Feb. 24, 2010

(65) Prior Publication Data

US 2011/0146519 A1 Jun. 23, 2011

Related U.S. Application Data

(60) Provisional application No. 61/289,584, filed on Dec. 23, 2009.

(51) Int. Cl.

| | |
|---|---|
| ***C06B 45/00*** | (2006.01) |
| ***C06B 33/00*** | (2006.01) |
| ***C06B 33/08*** | (2006.01) |
| ***D03D 23/00*** | (2006.01) |
| ***D03D 43/00*** | (2006.01) |

(52) U.S. Cl.
USPC ..... 149/37; 149/2; 149/38; 149/108.2; 149/109.2; 149/109.4

(58) Field of Classification Search
USPC ..... 149/2, 37, 38, 108.2, 109.2, 109.4
See application file for complete search history.

(56) References Cited

U.S. PATENT DOCUMENTS

| | | | | |
|---|---|---|---|---|
| 2,076,308 | A * | 4/1937 | Wells | 166/300 |
| 2,530,491 | A * | 11/1950 | Van Loenen | 149/6 |
| 3,066,058 | A * | 11/1962 | Gall | 149/1 |
| 3,212,439 | A * | 10/1965 | Reyne | 102/202.14 |
| 5,466,537 | A * | 11/1995 | Diede et al. | 428/548 |
| 5,739,184 | A | 4/1998 | Marbry et al. | |
| 6,008,281 | A | 12/1999 | Yang et al. | |
| 6,048,379 | A | 4/2000 | Bray et al. | |
| 6,349,649 | B1 | 2/2002 | Jacoby et al. | |
| 6,386,109 | B1 | 5/2002 | Brooks et al. | |
| 7,074,254 | B2 | 7/2006 | Fujisawa et al. | |
| 7,384,446 | B2 | 6/2008 | Unami et al. | |
| 7,393,423 | B2 * | 7/2008 | Liu | 149/38 |
| 7,658,148 | B2 * | 2/2010 | Langan et al. | 102/306 |
| 2006/0070739 | A1 | 4/2006 | Brooks et al. | |
| 2009/0078144 | A1 | 3/2009 | Behrmann et al. | |
| 2009/0114382 | A1 | 5/2009 | Grove et al. | |
| 2009/0151949 | A1 | 6/2009 | Marya et al. | |

FOREIGN PATENT DOCUMENTS

WO 2005035939 A1 4/2005

* cited by examiner

*Primary Examiner* — James McDonough
(74) *Attorney, Agent, or Firm* — Jeffrey R. Peterson; Brandon S. Clark

(57) ABSTRACT

Disclosed are thermite charges for use in well perforation and downhole fracing. The thermite charges have a core, and optionally a case, where at least one of the core and the case includes thermite material.

17 Claims, 12 Drawing Sheets

PERFORATING DEVICES UTILIZING THERMITE CHARGES IN WELL PERFORATION AND DOWNHOLE FRACING

CROSS-REFERENCE TO RELATED APPLICATION

The present document is based on and claims priority to U.S. Provisional Application Ser. No. 61/289,584, filed Dec. 23, 2009, the contents of which are herein incorporated by reference in their entirety

BACKGROUND

The present application relates generally to charges that include a thermite core and the use thereof in well perforation and downhole fracing.

Perforating or fracing devices are often used to complete oil and natural gas wells. Typically, these devices having an array of charges are lowered downhole into a well having a casing. When the device is at the correct depth in the well, the charges are fired, sending shaped charge jets outward through the side of the device, through any fluid between the device and the well casing, through the well casing, and finally into the oil-bearing or natural-gas bearing rock. The resulting holes in the well casing allow oil or natural gas to flow into the well and to the surface. After the charges have been fired, the remains of the device may then be withdrawn from the well or left in the well. Perforating device technology is disclosed in the art. (See, e.g., U.S. Published Application Nos. 2009/0114382; 2009/0151949; and 2006/0070739; and U.S. Pat. Nos. 6,349,649; and 6,386,109, which are incorporated by reference in their entireties).

A charge for a perforating or fracing device typically includes an energy source within its core, some mechanism to ignite the energy source, and optionally a case and optionally a liner. Energy sources typically include explosive materials, and new, non-explosive energy sources for charges are desirable. Here, thermite material is disclosed as a suitable material for charges, where after ignition, thermite material typically exhibits deflagration rather than explosion. While thermite material has been used in the art for forming liners for charges, liners typically represent a small percentage of the total weight of a charge (i.e., less than 5% of the total weight of the charge). As such, material of a charge liner typically does not provide an energy source for the charge.

SUMMARY

Disclosed is the use of thermite material as an energy source in charges for perforation or fracing in completing a well. In some embodiments, the charges, which may be shaped or non-shaped charges, cased or caseless charges, and having a liner or linerless, may comprise thermite material or may consist of thermite material as a sole energy source. In some embodiments, the charges may comprise thermite material in the core of the charge or in the case of the charge.

The thermite material of the charges as contemplated herein includes a pyrotechnic mixture of a fuel source, which is a zero valent oxidizable element (E(0)), and an oxide compound (XO) that provides oxygen for oxidizing or burning the fuel source. In some embodiments, thermite material for use in charges as contemplated herein includes a mixture of a metal powder (as a fuel source) and a metal oxide. Suitable thermite materials for the charges contemplated herein include, but are not limited to, mixtures of aluminum powder Al(0) and iron oxide (e.g., $Fe_3O_4$, $Fe_2O_3$, or FeO). The fuel source and oxide compound may be present in the thermite material in a suitable molar ratio (i.e., E(0):XO), including a ratio within a range of about 1:(1-10), about 1:(1-5), or preferably at a ratio of about 1:3.

The charges contemplated herein typically comprise thermite material as an energy source. The thermite material may be present in a core of a charge, in a case of a charge, or in both a core and a case of a charge. In some embodiments, thermite material represents at least about 5%, 10%, 20%, 30%, 40%, 50%, 60%, 70%, 80%, 90%, or 95% of total weight of the charge (or at least about 5%, 10%, 20%, 30%, 40%, 50%, 60%, 70%, 80%, 90%, or 95% of total weight of a core of a charge, or at least about 5%, 10%, 20%, 30%, 40%, 50%, 60%, 70%, 80%, 90%, or 95% of total weight of a case for a charge). In further embodiments, the charge consists of thermite material (i.e., the charge is 100% thermite material). In even further embodiments, the core of the charge consists of thermite material (i.e., the core is 100% thermite material), or the case of the charge consists of thermite material (i.e., the case is 100% thermite material).

Optionally, the charges contemplated herein include a case or a liner for the core of the charge, for example, where the case or liner at least partially surrounds a thermite energy source that is present in the core of the charge. Suitable materials for the optional case may include, but are not limited to, thermite material as discussed herein, and also steel and zinc. Suitable materials for the optional liner may include, but are not limited to, thermite material as known in the art, and also copper, zinc and various alloys or pressed powders that include mixtures of copper, lead and tungsten.

Also disclosed are methods for making a thermite charge and methods for making a core or a case for a thermite charge. The methods may include: (a) combining: (i) a fuel source in a form of a coarse powder; (ii) an oxide compound in a form of a coarse powder; and optionally (iii) a binder; thereby obtaining a mixture; and (b) forming from the mixture the thermite charge or the core or the case for the thermite charge, for example, by molding or compacting the mixture.

The charges disclosed herein may be utilized in methods for perforation or fracing in completing a well. The methods may include loading the thermite charges in a perforator device, positioning the device in a well, and igniting the charges. Optionally, in fracing methods, a brine fluid may be placed in the well prior to igniting the charges. In some embodiments, heat released by igniting the charges heats the brine fluid and creates pressure in the well. The pressure is exerted into the well formation and creates fractures or extends and expands existing fractures present in target zones of the well formation.

BRIEF DESCRIPTION OF THE DRAWINGS

The best mode is described with reference to the following drawing figures.

DETAILED DESCRIPTION

Figure 1:
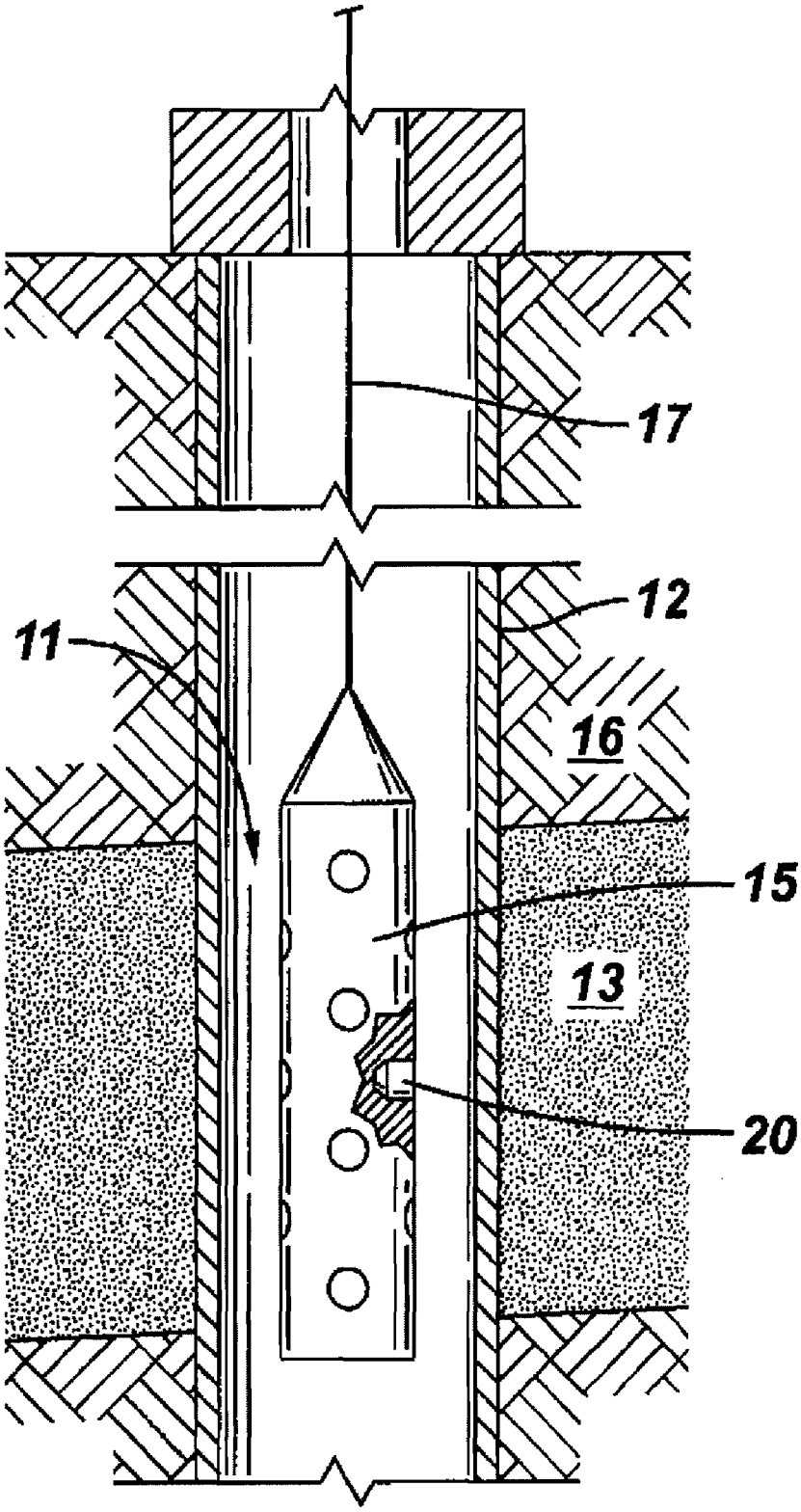
FIG. 1 (PRIOR ART)
FIG. 1 shows a perforation operation of the prior art, illustrating a perforation device disposed in a well.

The disclosed subject matter is further described below.

Unless otherwise specified or indicated by context, the terms "a", "an", and "the" mean "one or more."

As used herein, "about", "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus ≤10% of the particular term and "substantially" and "significantly" will mean plus or minus >10% of the particular term.

As used herein, the terms "include" and "including" have the same meaning as the terms "comprise" and "comprising."

Unless otherwise indicated, percentages referring to compositions indicate (w/w) percentages.

The thermite material of the charges as contemplated herein includes a pyrotechnic mixture of a fuel source, which is a zero valent oxidizable element (E(0)), and an oxide compound (XO) that provides oxygen for oxidizing or burning the fuel source. Suitable fuel sources may include, but are not limited to aluminum, magnesium, calcium, titanium, zinc, silicon, boron, and mixtures thereof. Suitable oxide compounds may include, but are not limited to, oxides of iron (including iron(II) or iron(III) oxides such as $Fe_3O_4$, $Fe_2O_3$, or FeO), copper(II), boron(III), silicon(IV), chromium(III), manganese(IV), and lead (including lead(II) or lead(IV) oxides). In some embodiments, thermite material for use in charges as contemplated herein includes a mixture of a metal (as a fuel source) and a metal oxide. Suitable thermite materials for the charges contemplated herein include, but are not limited to, mixtures of aluminum (i.e., Al(0)) and iron oxide (e.g., $Fe_3O_4$, $Fe_2O_3$, or FeO). The fuel source and oxide compound may be present in the thermite material in a suitable molar ratio (i.e., E(0):XO), including a ratio within a range of about 1:(1-10) or about 1:(1-5). Preferably, fuel source and oxide compound are present in the thermite material in a molar ratio of about 1:3.

The thermite material of the charges as contemplated herein may be prepared by combining a fuel source in the form of a powder (e.g., a metal powder) and an oxide compound in the form of a powder (e.g., a powdered metal oxide). In some embodiments, the thermite material is prepared by combining aluminum powder and iron oxide powder (e.g., $Fe_3O_4$, $Fe_2O_3$, or FeO powder). Preferably, the powders used to prepare the thermite material (i.e., the fuel source in the form of a powder and the oxide compound in the form of a powder) are coarse powders having an average particle size greater than 10 microns, (more preferably an average particle size greater than 50 microns, even more preferably an average particle size greater than 100 microns, most preferably an average particle size greater than 200 microns). It has been observed that a coarse powder of a fuel source and a coarse powder of an oxide compound can be more easily combined to form a solid mass of thermite material that does not disintegrate, as compared to thermite material prepared from fine powders having an average particle size of less than about 10 microns. Suitable ranges for the average particle size of coarse powders as contemplated herein may include, but are not limited to, 10-2000 microns, 10-1000 microns, 50-1000 microns, and 100-1000 microns.

In some embodiments, the thermite material of the charges as contemplated herein may be prepared by combining a fuel source in the form of a powder (e.g., a metal powder) and an oxide compound in the form of a powder (e.g., a powdered metal oxide) together with a binder. Powder metallurgy and the use of powdered materials and binders for forming shaped articles are known in the art. (See, e.g., U.S. Pat. No. 6,048,379, which is incorporated by reference in its entirety.) Shaped components for charges can be prepared by forming a mixture comprising thermite material and a binder. Suitable binders will hold together particles of the thermite material. For example, in some embodiments, a charge as contemplated herein (or a core of the charge, or a case of the charge) comprises about 0-1%, 0-2%, 0-5%, 0-10%, 0-15%, or 0-20% (w/w) binder, the remainder being thermite material. Suitable binders may include, but are not limited to, malleable metal powders (e.g., copper, lead, or tin powders, which, as contemplated herein, further may serve as a fuel source for the thermite material). Other binders for powder metallurgy are known in the art. (See, e.g., U.S. Pat. Nos. 7,384,446; 7,074,254; and 6,008,281; the contents of which are incorporated by reference herein in their entireties). For example, suitable binders as contemplated herein may include, but are not limited to, epoxy powder (e.g. Scotchkote® Brand Fusion Bonded Epoxy Powder such as 226N+ epoxy powder, available from 3M Corporation) and thermosetting epoxy resin (e.g., Scotchcast 265 thermosetting epoxy resin, also available from 3M Corporation). Other suitable binders may include polyurethane resin or polyester resin. Thermosetting resins are known in the art. (See, e.g., U.S. Pat. No. 5,739,184, which content is incorporated by reference herein in its entirety.) Other suitable binders include waxes and polymeric binders. (See, e.g., U.S. Pat. No. 6,048,379, which content is incorporated by reference herein in its entirety). Shaped charges may be prepared by combining thermite material and a binder to form a mixture which is then placed into a mold. Subsequently, the shaped charge is removed from the mold. Optionally, the mold surface may have been treated with a release agent to facilitate removal of the shaped charged. Optionally, the thermite/binder mixture may be pressed in the mold via applying tonnage.

The charges contemplated herein optionally may include steel, for example, as present in a case for a thermite core. Steel, as contemplated herein, is a mixture or alloy that includes mainly iron, with a carbon content between 0.2% and 2.04% by weight, depending on grade. Various other alloying or nodularizing elements may be present in steel such as manganese, chromium, vanadium, tungsten, tin, copper, lead, silicon, nickel, magnesium.

As disclosed herein, thermite has been identified as an alternate energy source for charges in well perforation or fracing, as opposed to commonly utilized explosive material. Thermites are energy rich materials that are relatively stable.

Thermite energy can be released at high rates. However, release of thermite energy typically causes deflagration rather than explosion. In the presently contemplated methods, release of thermite energy can be harnesses for downhole perforation and fracing. The contemplated charges may be designed for use in perforating devices as known in the art and as contemplated herein. The thermite charges contemplated herein may be shaped or non-shaped, cased or caseless, and having a liner or linerless.

The thermite charges contemplated herein include thermite material as an energy source (e.g., as present in a core of the charge, as present in a case of the charge, or as present in both). In some embodiments, thermite material represents at least about 5%, 10%, 20%, 30%, 40%, 50%, 60%, 70%, 80%, 90%, or 95% of total weight of the charge (or total weight of the core of the charge, or total weight of the case of the charge). In further embodiments, the charge consists of thermite material (e.g., the charge is 100% thermite material and does not include a case or a liner). Thermite material may be the sole energy source of the charge or thermite material may be combined with an explosive material to make a hybrid thermite/explosive charge. In some embodiments, thermite material represents at least about 5%, 10%, 20%, 30%, 40%, 50%, 60%, 70%, 80%, 90%, or 95% of total weight of the energy source of the charge the remainder being explosive material. In further embodiments, the energy source of the charge consists of thermite material (i.e., the energy source is 100% thermite material). In further embodiments, the thermite charges contemplated herein comprise a core, a case, and optionally a liner. In these further embodiments, thermite material represents at least about 5%, 10%, 20%, 30%, 40%, 50%, 60%, 70%, 80%, 90%, or 95% of total weight of the core of the charge. In these further embodiments, the core of the charge may consist of thermite material (i.e., the core of the charge is 100% thermite material and the charge optionally includes a case and optionally includes a liner). In these further embodiments, thermite material may represent at least about 5%, 10%, 20%, 30%, 40%, 50%, 60%, 70%, 80%, 90%, or 95% of total weight of the case of the charge. In these further embodiments, the case of the charge may consist of thermite material (i.e., the case of the charge is 100% thermite material and the charge optionally includes a liner). In even further embodiments, the case of the charge may consist of thermite material and the core may comprise an initial power source (e.g., an initial ignition material).

The presently disclosed charges may be utilized in perforating and fracing devices as known in the art. (See, e.g., U.S. Published Application No. 2009/0114382, the content of which is incorporated by reference in its entirety). As referred to herein, a "perforating device" may include a device utilized for perforating, fracing, or both. Perforating devices may include, but are not limited to, exposed systems having charges mounted on an ignition cord, gun carriers having shaped charges mounted on or in the gun carriers, and sealed capsule charges where optionally the sealed capsule may include holes adjacent the charges.

Referring now to FIG. 1, after a well 11 is drilled, a casing 12 is typically run in the well 11 and cemented to the well 11 in order to maintain well integrity. After the casing 12 has been cemented in the well 11, one or more sections of the casing 12 that are adjacent to a formation zone of interest, otherwise referred to as a "target zone," may be perforated to allow fluid from the target zone 13 to flow into the well for production to the surface or to allow injection fluids to be applied into the target zone 13. To perforate a casing section, a perforating device 15 may be lowered into the well 11 to a desired depth, such as at a depth corresponding to the target zone 13 in the surrounding formation 16. Next, one or more charges 20 are fired to create openings in the casing 12 and to create perforations into the target zone 13 of the well formation 16. In fracing devices, one or more charges 20 are fired to create fractures or to extend and expand existing fractures present in the target zone 13 of the well formation 16. Production fluids in the target zone 13 can then flow through the fractures, through the perforation in the casing, and into the wellbore.

Figure 2:
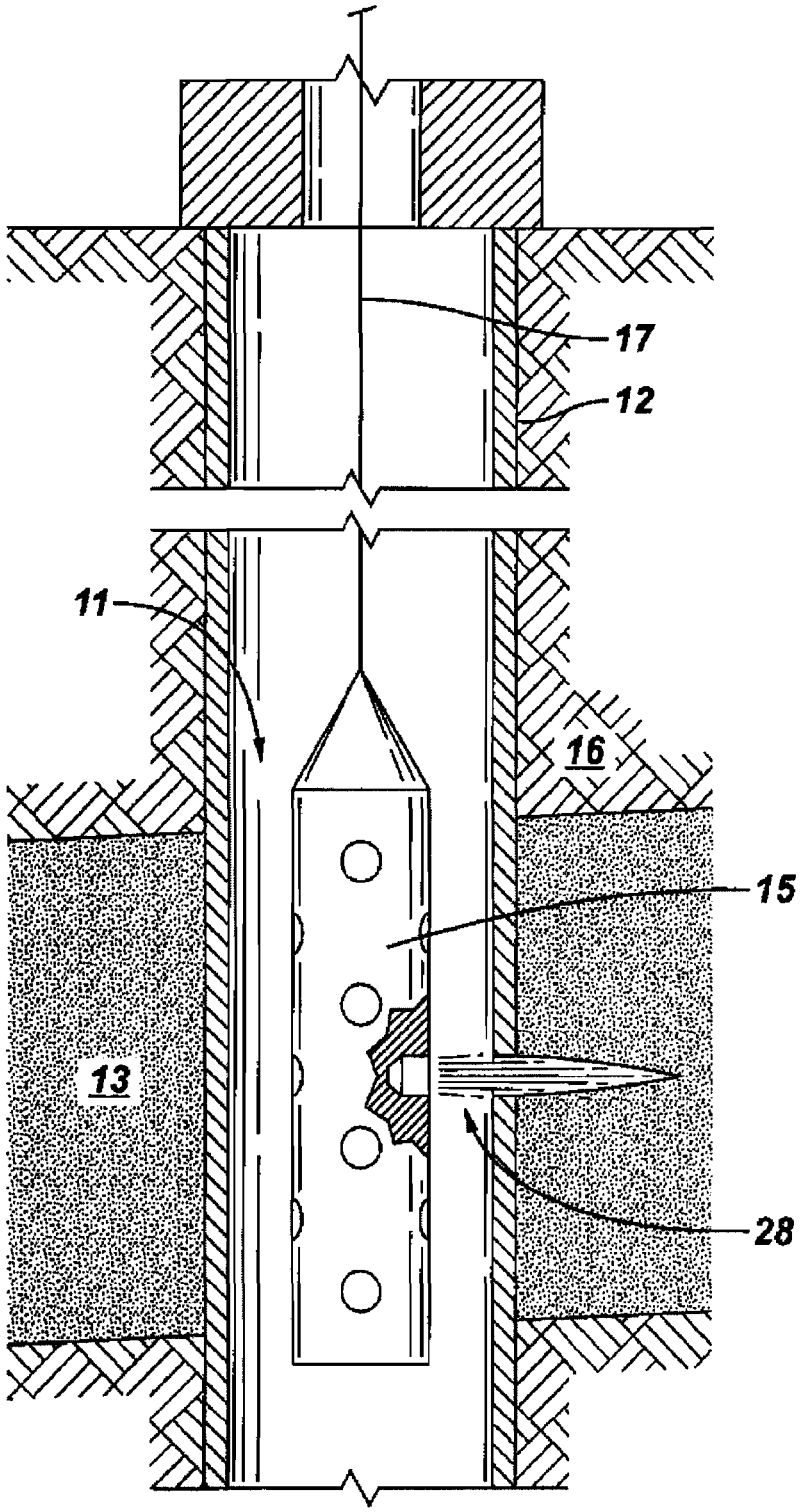
FIG. 2 (PRIOR ART)
FIG. 2 shows a diagram illustrating a perforation being made with a perforating device as illustrated in FIG. 1.

Typically, perforating devices 15 are lowered through tubing or other pipes to the desired depth on a line 17 (e.g., wireline, e-line, slickline, coiled tubing, and so forth). The charges carried in a perforating device may be phased to fire in multiple directions around the circumference of the wellbore. Alternatively, the charges may be aligned in a straight line. When fired, the charges create perforating jets 28 that form holes in the surrounding casing as well as extend perforation tunnels or fractures in the target zone. (See FIG. 2).

Figure 3:
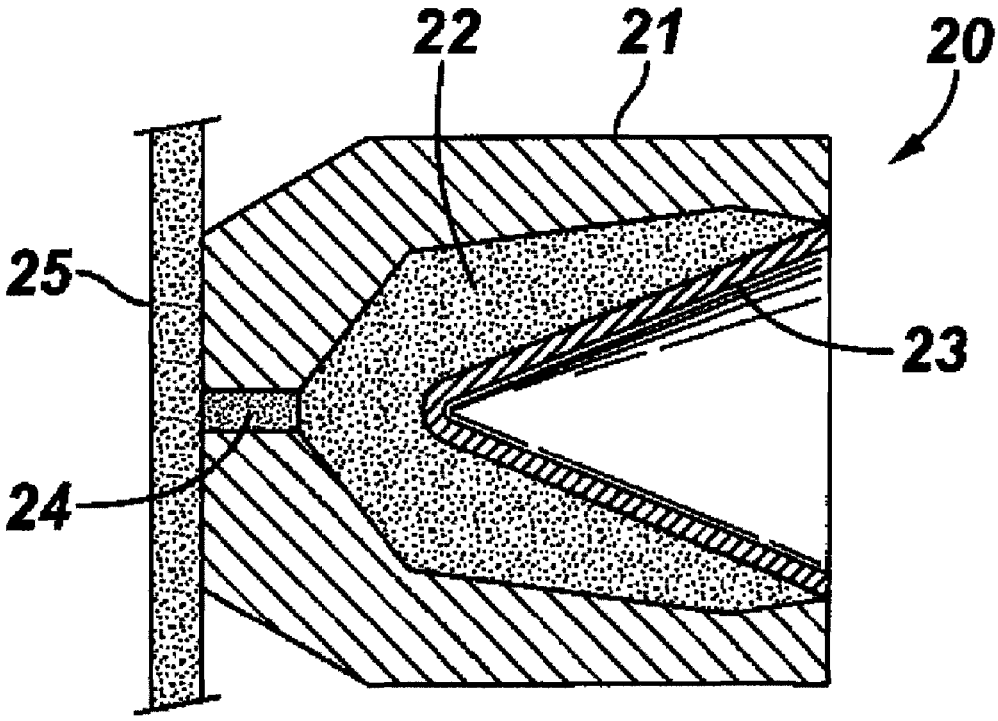
FIG. 3 (PRIOR ART)
FIG. 3 shows a shaped explosive charge of the prior art for use in a perforating operation as shown in FIG. 1 an FIG. 2.
Figure 4:
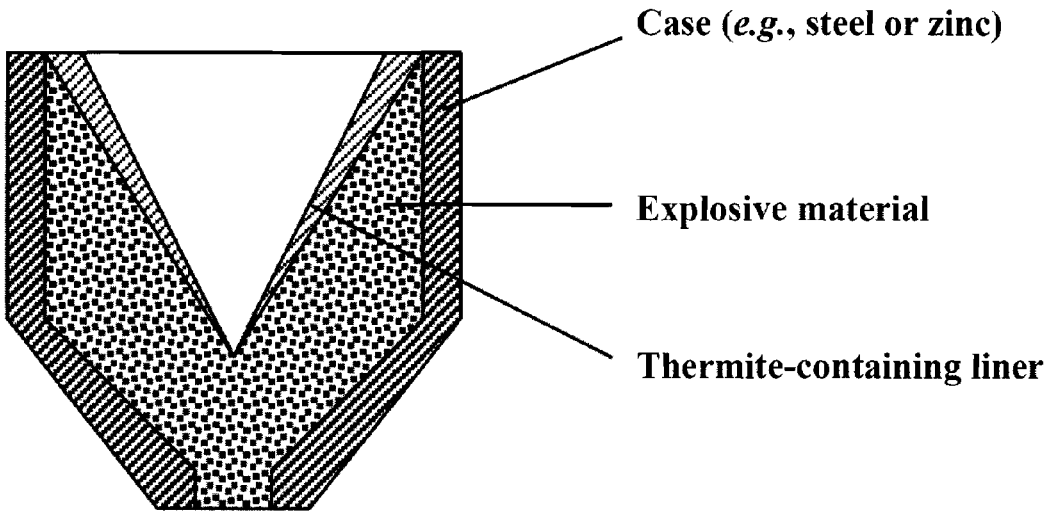
FIG. 4 (PRIOR ART)
FIG. 4 shows a shaped explosive charge of the prior art having a core comprising an explosive, a case, and a liner that includes thermite material.

FIG. 3 shows an example of a shaped charge perforator 20 of the prior art for use in an oil and gas well. The perforator 20 has a liner 23 and an explosive charge 22 contained in a case 21. A detonating cord 25 may be positioned at an opening 24 located generally at the rear of the case. The outer surface of the case may be formed to fit into a holding apparatus inside a perforating gun. The particular size and shape of the exemplary perforator 20 and its components can vary greatly, as known in the art. Referring to FIG. 4, shown is a shaped explosive charge of the prior art having a core comprising an explosive, a case made of steel or zinc, and liner that includes thermite material, where thermite material represents a small percentage of the total charge (e.g., less than about 5% of the total weight of the charge). It should be recognized that the thermite charges contemplated herein are not limited to the particular structures or uses shown in FIG. 1-4.

Figure 5:
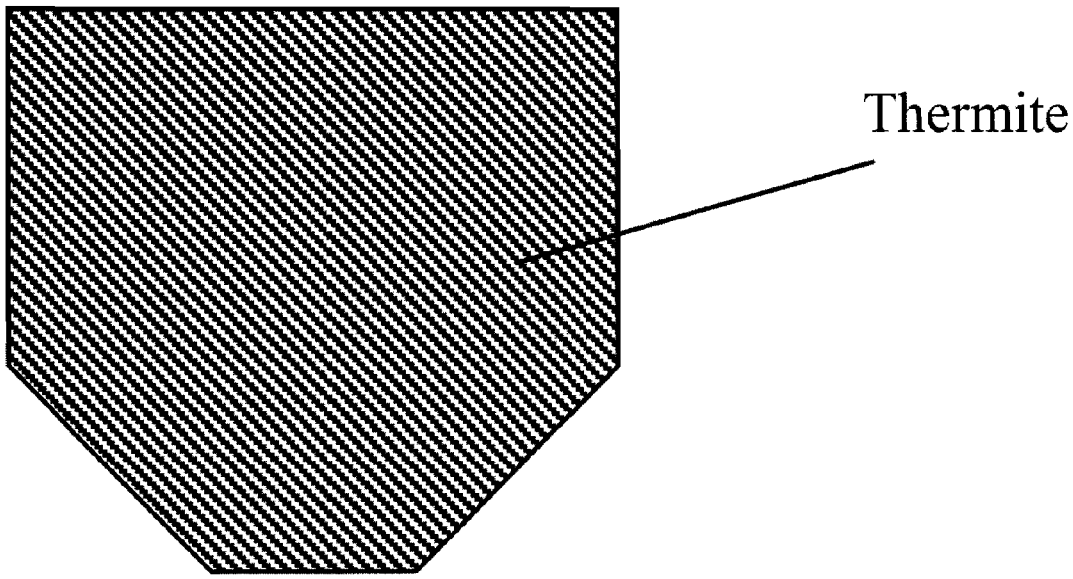
FIG. 5 shows one embodiment of a caseless thermite charge as contemplated herein.
Figure 6:
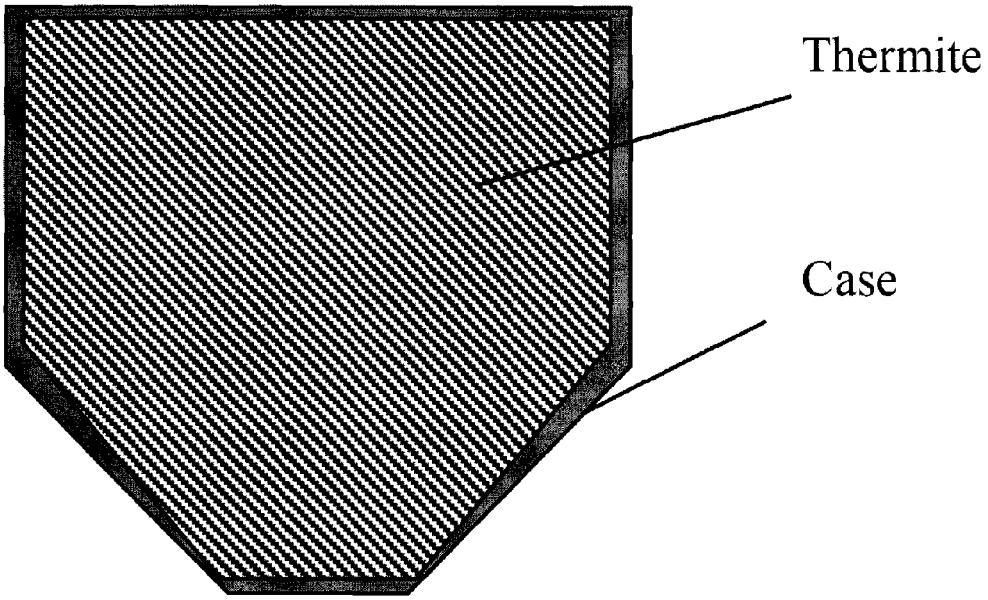
FIG. 6 shows one embodiment of a cased thermite charge as contemplated herein.

FIG. 5 and FIG. 6 show embodiments of thermite charges as contemplated herein. FIG. 5 shows a caseless thermite charge and FIG. 6 shows a cased thermite charge having a thermite core.

Figure 7:
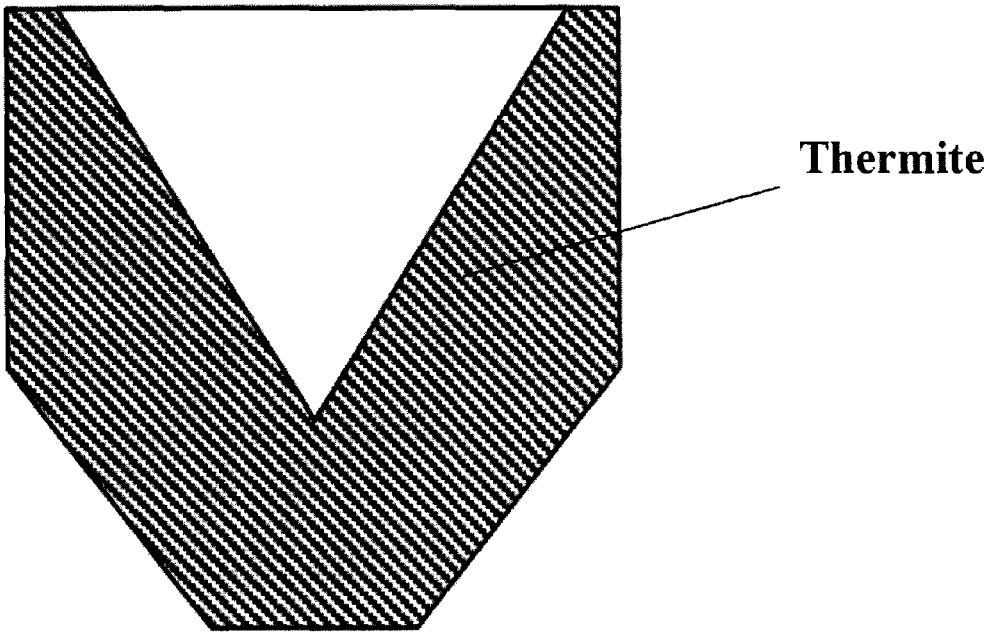
FIG. 7 shows one embodiment of a shaped thermite charge (cased or caseless) as contemplated herein.
Figure 8:
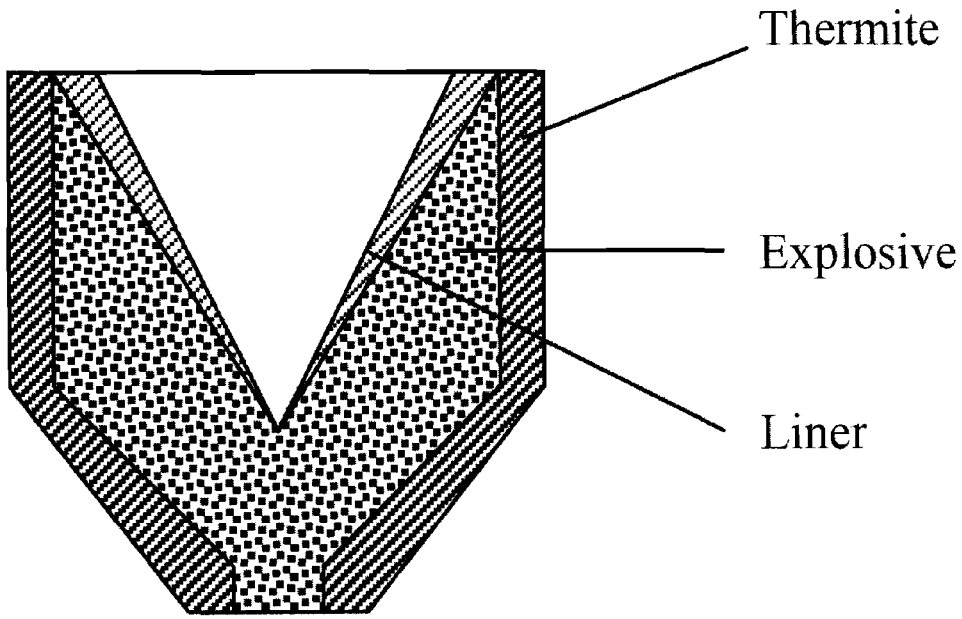
FIG. 8 shows one embodiment of a shaped explosive charge having a core comprising an explosive, a thermite case, and a liner made of copper, tungsten, or lead.
Figure 9:
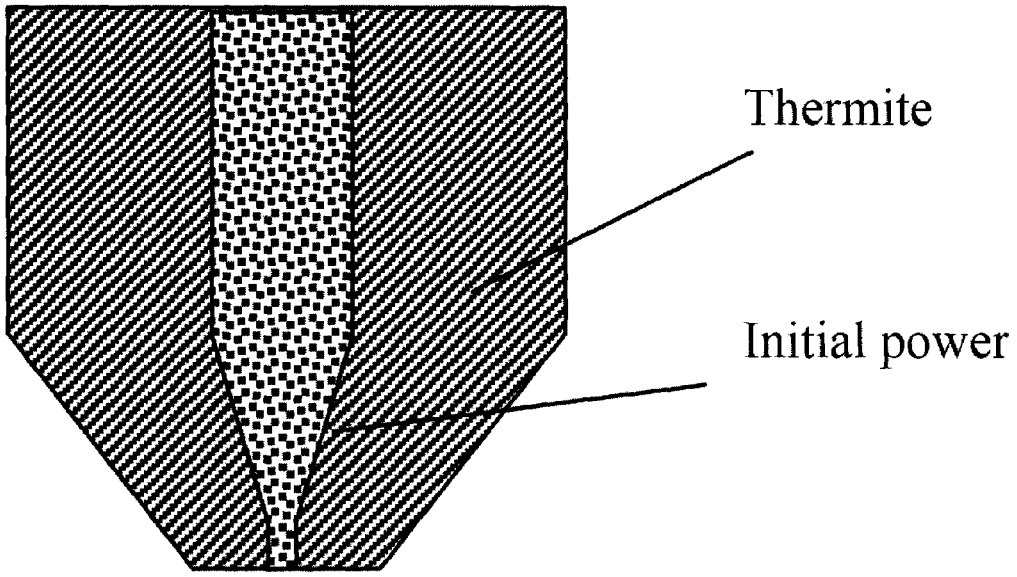
FIG. 9 shows one embodiment of a caseless thermite charge having central initial power (i.e., initial ignition material), as contemplated herein.

FIGS. 7-9 show embodiments of thermite charges as contemplated herein. Referring to FIG. 7, shown is a shaped thermite charge (cased or caseless) having a thermite core. FIG. 8 shows a shaped explosive charge having a core comprising an explosive, a thermite case, and a liner made of copper, tungsten, or lead. FIG. 9 shows a caseless thermite charge having central initiation material (i.e., ignition material).

Figure 10:
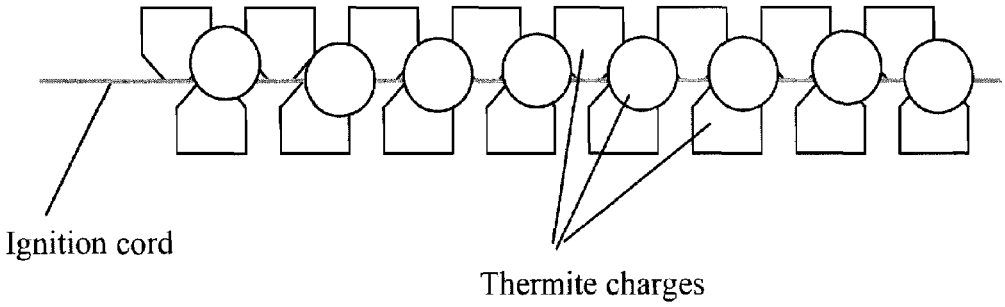
FIG. 10 shows a cross-sectional view of one embodiment of thermite charges placed in an exposed system for lowering into a well.
Figure 11:
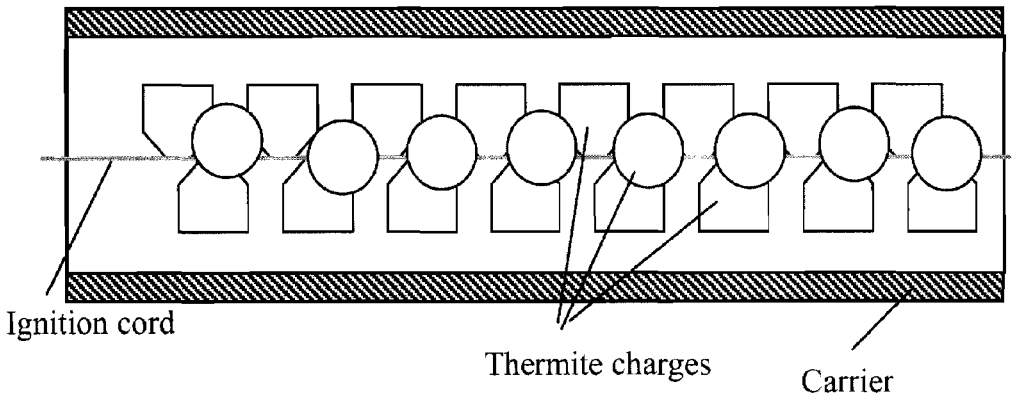
FIG. 11 shows a cross-sectional view of one embodiment of thermite charges placed in a hollow carrier perforating gun for lowering into a well.
Figure 12:
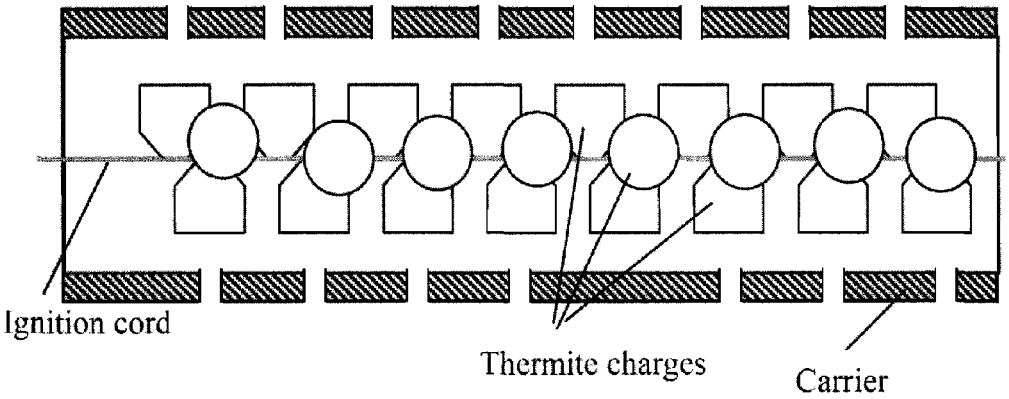
FIG. 12 shows a cross-sectional view of one embodiment of thermite charges placed in a hollow carrier perforating gun having holes adjacent the charges.

FIGS. 10-12 show embodiments of perforating devices as contemplated herein. Referring to FIG. 10, shown are thermite charges placed in an exposed system. Referring to FIG. 11, shown are thermite charges placed in a hollow perforating carrier (i.e., gun). Referring to FIG. 12, shown are thermite charges placed in a hollow perforating carrier having holes adjacent the charges. In some embodiments, the thermite charge may be lowered into the well in a device of any of FIGS. 10-12. When the device is at the correct depth in the well, the thermite material of the charge is ignited via an igniting cord. Deflagration of the thermite charge heats the well. Saline fluid between the device and the well casing is heated and pressurized and enters the oil-bearing or natural-gas bearing rock formation creating fractures or extending existing fractures.

In the following description, certain terms have been used for brevity, clearness, and understanding. No unnecessary limitations are to be implied therefrom beyond the requirement of the prior art because such terms are used for descriptive purposes only and are intended to be broadly construed. The different apparatuses and method steps described herein may be used alone or in combination with other apparatuses and method steps. It is to be expected that various equivalents, alternatives and modifications are possible within the scope of the appended claims.

What is claimed is:

1. A hybrid charge for use in completing a well, the charge comprising:

a perforating liner for forming a perforation in the well at a well bore wall thereof;

an explosive core in contact with at least a portion of the liner; and a thermite-based deflagration case configured to heatably pressurize fluid of the well bore into the perforation.

2. The charge of claim 1, wherein the charge comprises at least about 50% thermite material.

3. The charge of claim 1, wherein the thermite-based case comprises a mixture of a fuel source and an oxide compound.

4. The charge of claim 3, wherein the fuel source is selected from a group consisting of aluminum, magnesium, calcium, titanium, zinc, boron, and silicon.

5. The charge of claim 4, wherein the fuel source is aluminum.

6. The charge of claim 3, wherein the oxide compound is selected from a group consisting of oxides of iron, chromium, manganese, iron, copper, lead, silicon, and boron.

7. The charge of claim 6, wherein the oxide is iron oxide.

8. The charge of claim 7, wherein the iron oxide is $Fe_3O_4$.

9. The charge of claim 7, wherein the iron oxide is $Fe_2O_3$.

10. The charge of claim 7, wherein the iron oxide is FeO.

11. The charge of claim 3, wherein the fuel source is aluminum, the oxide compound is iron oxide, and the aluminum and the iron oxide are present at a molar ratio within a range of about 1:(1-10).

12. The charge of claim 3, wherein the fuel source is aluminum, the oxide compound is iron oxide, and the aluminum and the iron oxide are present at a molar ratio within a range of about 1:(1-5).

13. The charge of claim 3, wherein the fuel source is aluminum, the oxide compound is iron oxide, and the aluminum and the iron oxide are present at a molar ratio within a range of about 1:3.

14. A hybrid charge for use in completing a well, the charge comprising:

an explosive perforating core material configured to be exposed to wellbore fluids, the perforating core material configured to ignite thereby forming a perforation into a wall of the well; and a thermite-based deflagration material of the core including a mixture of aluminum and iron oxide at a molar ratio of about 1:3, wherein the core includes at least 50% thermite material so that as the thermite material deflagrates the wellbore fluids in contact therewith are heated and pressurize the well to create a perforating jet by way of the heated pressurized well bore fluids that perforates the well.

15. The charge of claim 1 wherein the charge comprises a shaped charge.

16. The charge of claim 14 comprising a liner that forms the perforating jet.

17. The charge of claim 14 wherein the charge comprises a shaped charge.

* * * * *